US010557642B2

(12) United States Patent
Brill et al.

(10) Patent No.: US 10,557,642 B2
(45) Date of Patent: Feb. 11, 2020

(54) DEHUMIDIFYING VENTILATOR

(71) Applicant: Therma-Stor LLC, Madison, WI (US)

(72) Inventors: Jared Michael Brill, Stoughton, WI (US); Joseph Anthony Beachler, Madison, WI (US)

(73) Assignee: Therma-Stor LLC, Madison, WI (US)

( * ) Notice: Subject to any disclaimer, the term of this patent is extended or adjusted under 35 U.S.C. 154(b) by 130 days.

(21) Appl. No.: 15/944,123

(22) Filed: Apr. 3, 2018

(65) Prior Publication Data

US 2019/0301764 A1 Oct. 3, 2019

(51) Int. Cl.

| | |
|---|---|
| ***F24F 11/50*** | (2018.01) |
| ***F24F 11/30*** | (2018.01) |
| ***F24F 3/14*** | (2006.01) |
| *F24F 110/20* | (2018.01) |

(52) U.S. Cl.

CPC ..... *F24F 11/50* (2018.01); *F24F 3/14* (2013.01); *F24F 11/30* (2018.01); *F24F 2110/20* (2018.01)

(58) Field of Classification Search

CPC .... F24F 11/50; F24F 11/30; F24F 3/14; F24F 2110/20

See application file for complete search history.

(56) References Cited

U.S. PATENT DOCUMENTS

| | | | | |
|---|---|---|---|---|
| 2018/0106490 | A1* | 4/2018 | Abrishamkar | G05D 23/1905 |
| 2018/0106491 | A1* | 4/2018 | Abrishamkar | G05D 23/1905 |
| 2018/0156487 | A1* | 6/2018 | Beitelmal | G05D 23/1917 |

* cited by examiner

*Primary Examiner* — Filip Zec

(74) *Attorney, Agent, or Firm* — Baker Botts L.L.P.

(57) ABSTRACT

A dehumidifying ventilator includes a dehumidistat switch and a user-selection switch coupled to the dehumidistat switch. The dehumidistat switch is operable to enable and disable dehumidification of the dehumidifying ventilator. The user-selection switch includes a plurality of user-selectable positions. Each position corresponds to a particular climate zone of a plurality of climate zones. Each climate zone corresponds to a particular relative humidity. The user-selection switch is operable to cause the dehumidistat switch to enable the dehumidification system when a relative humidity of the input airflow is greater than or equal to the particular relativity humidity of a selected position of the user-selection switch. The user-selection switch is further operable to cause the dehumidistat switch to disable the dehumidification system when the relative humidity of the input airflow is less than the particular relativity humidity of the selected position of the user-selection switch.

20 Claims, 4 Drawing Sheets

DEHUMIDIFYING VENTILATOR

TECHNICAL FIELD

This invention relates generally to ventilation and more particularly to a dehumidifying ventilator.

BACKGROUND OF THE INVENTION

Many residences and businesses utilize ventilation systems to circulate exterior air to interior living/working spaces. For example, a whole-house ventilation system may be installed with an air handler to circulate exterior air to the living spaces of a home. Some ventilators may also provide dehumidification to incoming exterior air. Current ventilators, however, may not provide sufficient dehumidification or may provide unnecessary dehumidification in certain conditions, thereby wasting energy.

SUMMARY OF THE INVENTION

According to embodiments of the present disclosure, disadvantages and problems associated with previous ventilation systems may be reduced or eliminated.

In some embodiments, a dehumidifying ventilator includes a dehumidistat switch and a user-selection switch coupled to the dehumidistat switch. The dehumidistat switch is operable to enable and disable dehumidification of the dehumidifying ventilator. The user-selection switch includes a plurality of user-selectable positions. Each position corresponds to a particular climate zone of a plurality of climate zones. Each climate zone corresponds to a particular relative humidity. The user-selection switch is operable to cause the dehumidistat switch to enable the dehumidification system when a relative humidity of the input airflow is greater than or equal to the particular relativity humidity of a selected position of the user-selection switch. The user-selection switch is further operable to cause the dehumidistat switch to disable the dehumidification system when the relative humidity of the input airflow is less than the particular relativity humidity of the selected position of the user-selection switch.

Certain embodiments of the present disclosure may provide one or more technical advantages. Some embodiments provide a ventilating system that actively dehumidifies incoming ventilation air by performing a form of dew point control using a relative humidity sensor and in the absence of a temperature sensor. For example, in some embodiments, the dehumidification system only operates when the moisture level of the incoming air is above a certain level as set by a zone selection switch. The positions of the zone selection switch correspond to different climate zones of a particular geographical region such as a country. Each climate zone may correspond to a different relative humidity amount, and the climate zones may be defined based on a certain mean daily dew point. By dehumidifying the incoming ventilation air only when the relative humidity of the incoming air is above the relative humidity amount corresponding to the climate zone of the selected position of the zone selection switch, the amount of overdrying and underdrying of the ventilator may be minimized. This may reduce energy consumption and increase the affordability of operating the ventilation system.

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

Many residences and businesses utilize ventilation systems to circulate exterior air to interior living/working spaces. For example, a whole-house ventilator may be installed in conjunction with an air handler to circulate exterior air to the living spaces of a home. Some ventilators may also provide dehumidification to incoming exterior air. Current ventilators, however, may not provide sufficient dehumidification or may provide unnecessary dehumidification in certain conditions, thereby wasting energy.

To address the problems and inefficiencies of existing ventilation systems, the disclosed embodiments provide a ventilating system that actively dehumidifies incoming ventilation air when the moisture level of the incoming air exceeds a certain threshold that is based on a location of the ventilating system. For example, a geographical region (e.g., a country, state, county, city, etc.) may be partitioned into a predetermined number of climate regions based on a mean daily dew point reference temperature. The threshold for enabling/disabling a dehumidistat within the ventilating system may then be set based on the climate region in which the ventilating system is installed. As a result, the amount of overdrying and underdrying of the ventilating system may be minimized, thereby saving energy and regulating the ventilated humidity load.

Figure 1:
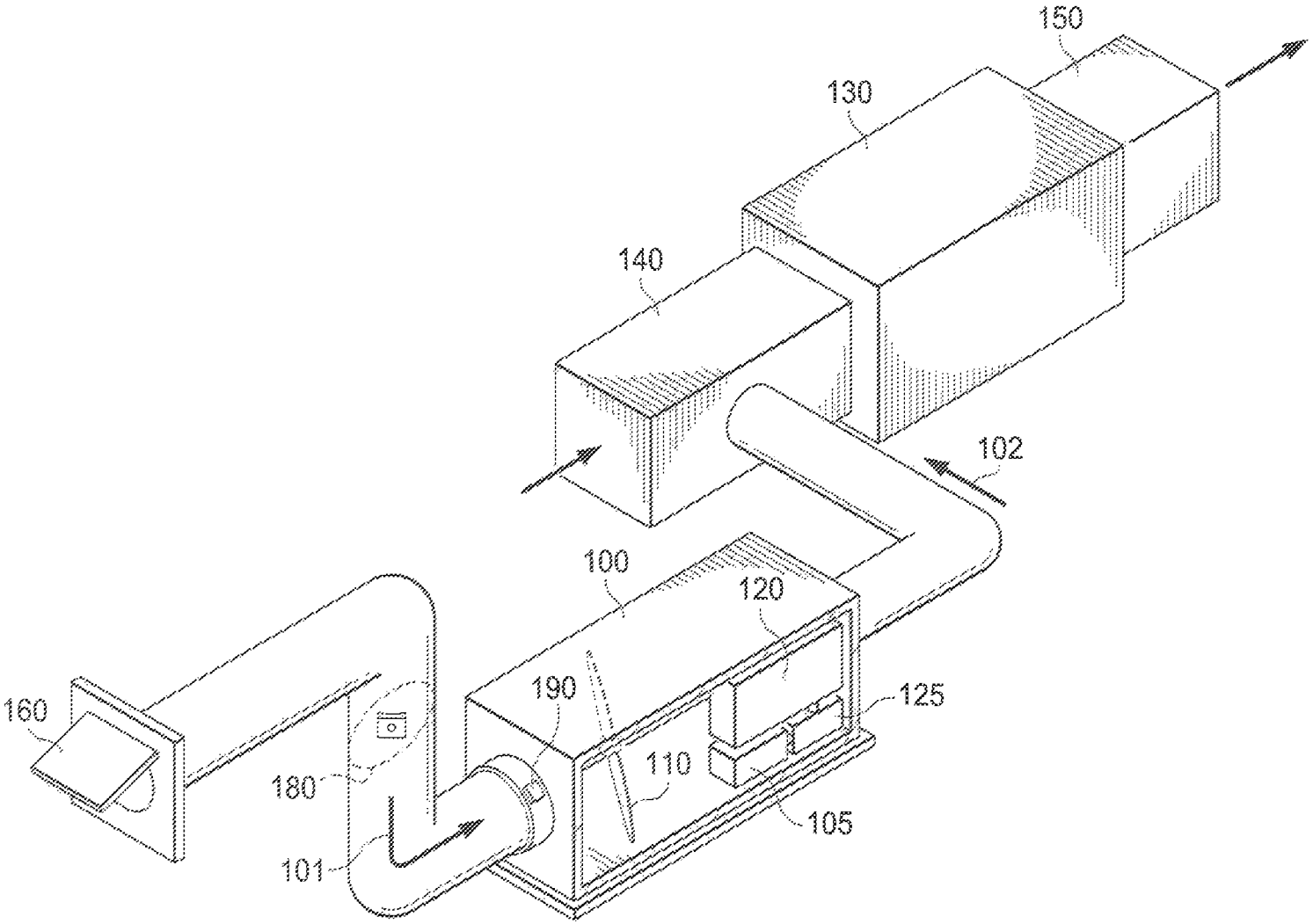
FIG. 1 illustrates a dehumidifying ventilator, according to certain embodiments.
Figure 2:
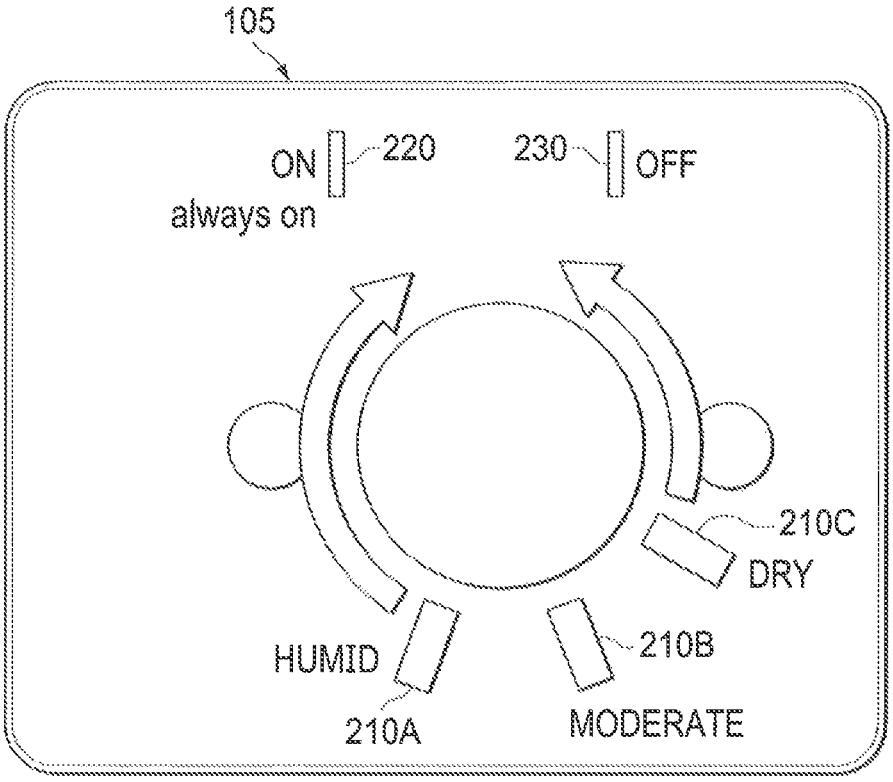
FIG. 2 illustrates a zone selection switch that may be utilized by the dehumidifying ventilator of FIG. 1, according to certain embodiments.
Figure 3:
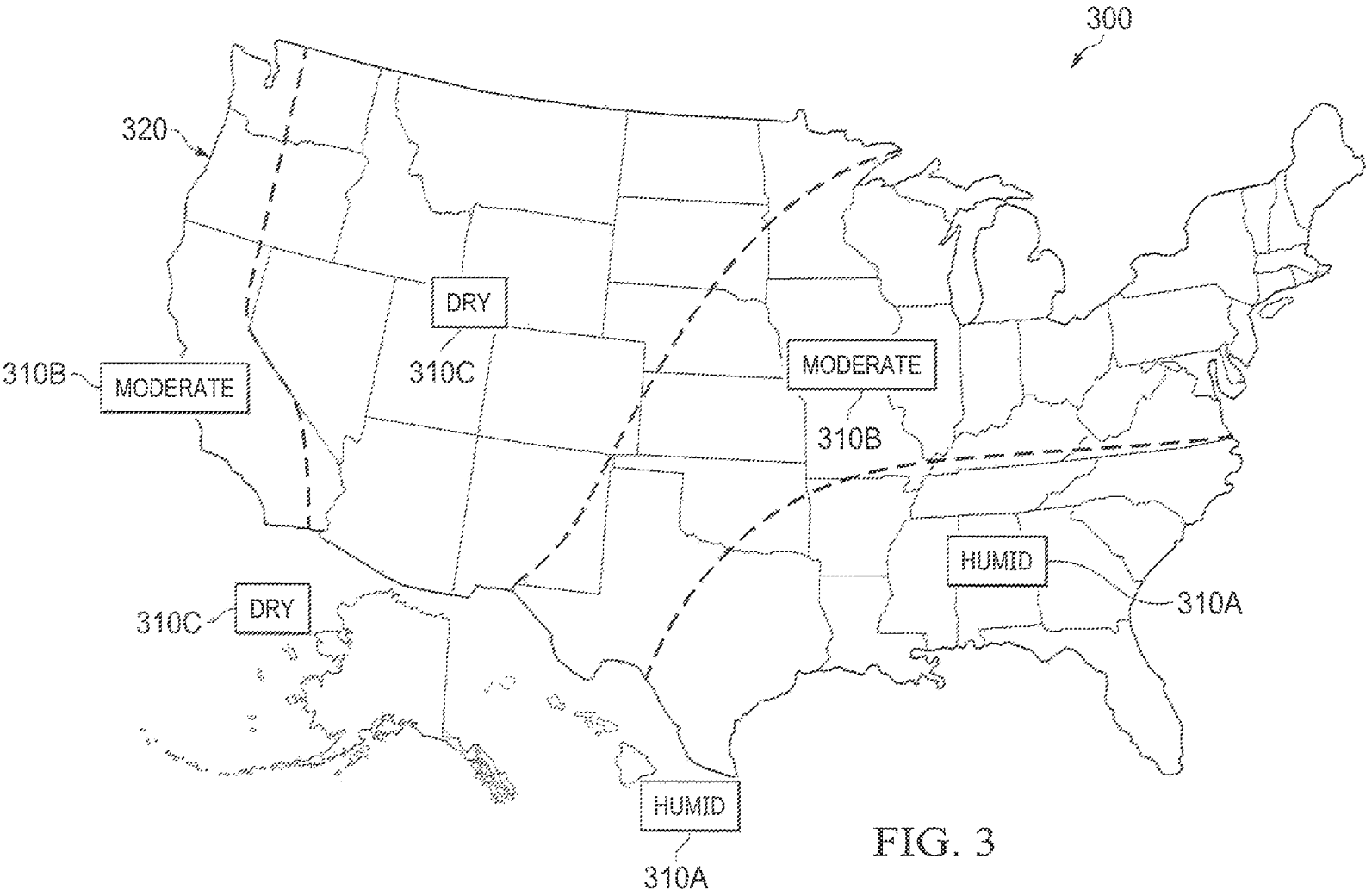
FIG. 3 illustrates a zone selection map, according to certain embodiments.
Figure 4:
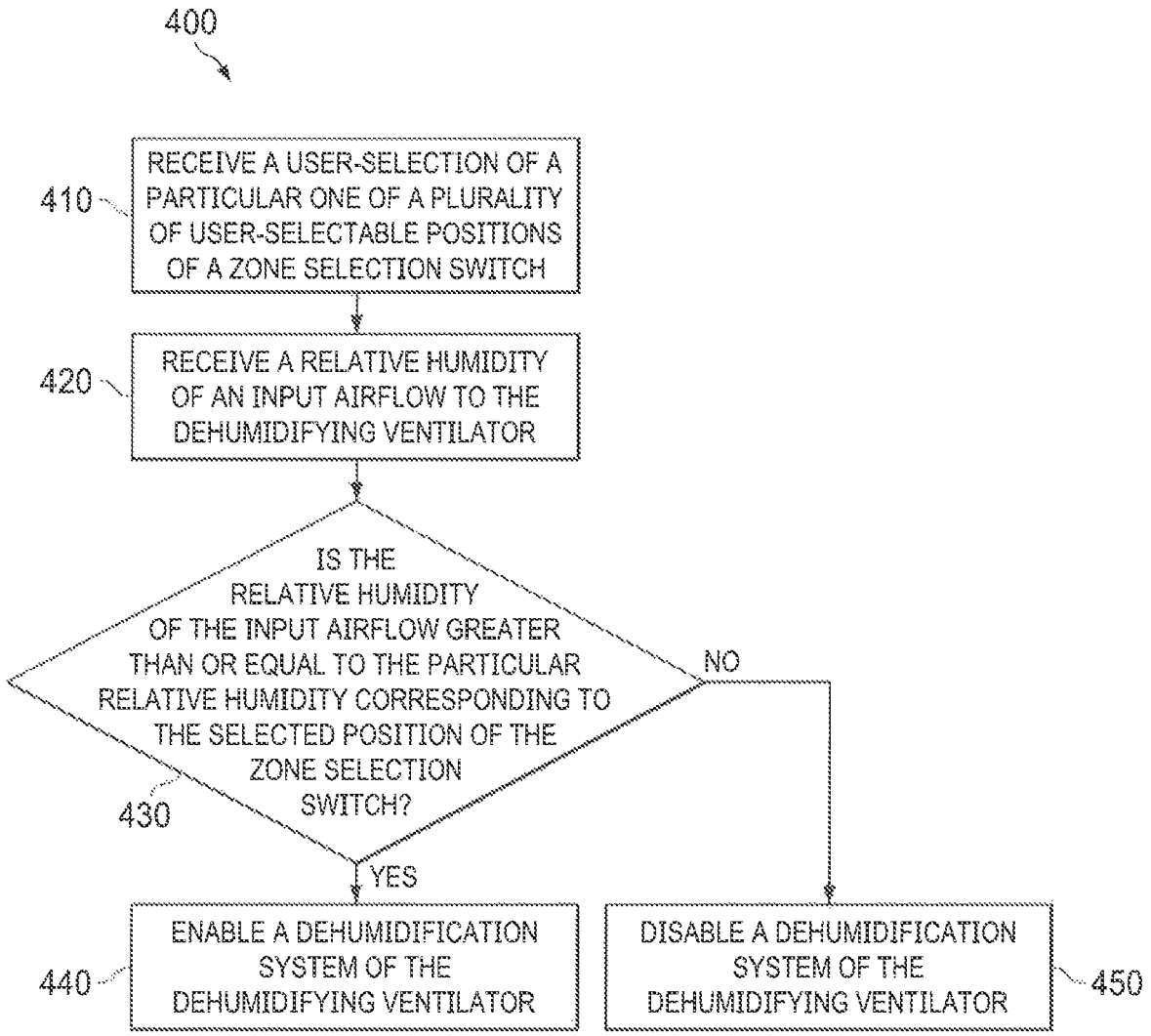
FIG. 4 illustrates a method of controlling the dehumidifying ventilator of FIG. 1, according to certain embodiments.

The advantages and features of certain embodiments are discussed in more detail below in reference to FIGS. 1-4. FIG. 1 illustrates a dehumidifying ventilator; FIG. 2 illustrates a zone selection switch that may be utilized by the dehumidifying ventilator of FIG. 1; FIG. 3 illustrates a zone selection map; and FIG. 4 illustrates a method of controlling the dehumidifying ventilator of FIG. 1, according to certain embodiments.

FIG. 1 illustrates a dehumidifying ventilator 100, according to certain embodiments. As illustrated in FIG. 1, dehumidifying ventilator 100 may be installed in conjunction with an air handler 130, which may be part of a heating, ventilation, and air conditioning (HVAC) system of a home or business. In this example, dehumidifying ventilator 100 provides ventilation air (i.e., output airflow 102) to an HVAC return 140. Air handler 130 provides heating or cooling to the incoming air and outputs conditioned air via HVAC supply 150. While dehumidifying ventilator 100 is illustrated in FIG. 1 as being installed with air handler 130, dehumidifying ventilator 100 may be installed in any other appropriate system or application, including stand-alone applications.

In some embodiments, dehumidifying ventilator 100 includes a fan 110, a dehumidification system 120, a dehumidistat switch 125, and a zone selection switch 105. Fan 110 generates an airflow through dehumidifying ventilator 100 that includes an input airflow 101 and an output airflow 102. Input airflow 101 may include exterior air (i.e., outside air) from a fresh air inlet 160. In some embodiments, a damper 180 may be included to enable/disable airflow from fresh air inlet 160. Dehumidification system 120 dehumidifies input airflow 101, resulting in an output airflow 102 that has a lower relative humidity than input airflow 101. Dehumidistat switch 125 is communicatively and/or electrically coupled to dehumidification system 120 and is operable to enable and disable dehumidification system 120. Zone selection switch 105, which is discussed in more detail below, is coupled to dehumidistat switch 125 and is operable to enable/disable dehumidistat switch 125 based on a particular relative humidity amount of a selected zone. In some embodiments, a sensor 190 (e.g., a relative humidity sensor) may be included within input airflow 101 in order to sense the relative humidity level of input airflow 101.

Fan 110 may be any type of air mover (e.g., axial fan, forward inclined impeller, backward inclined impeller, etc.) that is configured to generate input airflow 101 that flows into dehumidifying ventilator 100 and output airflow 102 that flows out of dehumidifying ventilator 100. Fan 110 may be located in any appropriate location within dehumidifying ventilator 100. In some embodiments, fan 110 is a variable-speed fan.

Dehumidification system 120 is any appropriate system or components that are configured to provide dehumidification to input airflow 101. In some embodiments, dehumidification system 120 includes a compressor (not illustrated). In general, dehumidification system 120 may be enabled and disabled by dehumidistat switch 125.

Dehumidistat switch 125 is any appropriate switch for enabling and disabling dehumidification system 120. In some embodiments, dehumidistat switch 125 is an electro-mechanical switch. Dehumidistat switch 125 is coupled to dehumidification system 120 and zone selection switch 105. In general, dehumidistat switch 125 enables dehumidification system 120 when the relative humidity of input airflow 101 is above a particular relative humidity amount associated with a selected zone of zone selection switch 105. Likewise, dehumidistat switch 125 disables dehumidification system 120 when the relative humidity of input airflow 101 is below a particular relative humidity associated with a selected zone of zone selection switch 105.

Damper 180 is any mechanism to enable or disable airflow from fresh air inlet 160 into dehumidifying ventilator 100. In some embodiments, damper 180 is a motorized damper that is controlled by dehumidifying ventilator 100. In other embodiments, damper 180 is a manual damper. In some embodiments, an additional or alternative damper 180 may be located to enable or disable airflow 101 into dehumidifying ventilator 100.

Sensor 190 is any appropriate sensor to detect properties of input airflow 101. In some embodiments, sensor 190 is a mechanical relative humidity sensor that senses the relative humidity of input airflow 101. In some embodiments, sensor 190 is located within input airflow 101, but may be in other locations in other embodiments.

Zone selection switch 105 is any appropriate switch that a user may set in order to control when dehumidifying ventilator 100 provides dehumidification to input airflow 101. In some embodiments, zone selection switch 105 is an electro-mechanical switch. In some embodiments, zone selection switch 105 is located on an external surface of dehumidifying ventilator 100 to allow for a user or installer to select a particular setting of zone selection switch 105. Particular embodiments of zone selection switch 105 are discussed below in reference to FIG. 2.

FIG. 2 illustrates a zone selection switch 105 that may be utilized by dehumidifying ventilator 100, according to certain embodiments. In this embodiment, zone selection switch 105 includes multiple user-selectable positions 210: a "humid" position 210A, a "moderate" position 210B, and a "dry" position 210C. Each user-selectable position 210 may correspond to a particular climate zone of a particular geographic region such as a continent, a country, a state, a county, or a city. For example, humid position 210A may correspond to a region of a country that has been predefined as a humid region. As another example, moderate position 210B may correspond to a region of a country that has been predefined as a moderate region. As another example, dry position 210C may correspond to a region of a country that has been predefined as a dry region. In some embodiments, zone selection switch 105 may additionally include an on position 220 and an off position 230. On position 220 may enable dehumidification system 120 of dehumidifying ventilator 100 at all times regardless of the relative humidity of input airflow 101, and off position 230 may disable dehumidification system 120 of dehumidifying ventilator 100 at all times regardless of the relative humidity of input airflow 101. While a particular number and arrangement of user-selectable positions 210 are illustrated in FIG. 2, other embodiments may have any other number or arrangement of user-selectable positions 210.

In some embodiments, each user-selectable position 210 may correspond to a predetermined relative humidity amount. In some embodiments, the relative humidity amounts of user-selectable positions 210 may be ten percent increments of each other. For example, humid position 210A may correspond to a relative humidity amount of 40%, moderate position 210B may correspond to a relative humidity amount of 50%, and dry position 210C may correspond to a relative humidity amount of 60%. While specific relative humidity amounts have been disclosed, any other appropriate relative humidity amounts may be used. For example, in some embodiments, humid position 210A may correspond to a relative humidity amount of 45%, moderate position 210B may correspond to a relative humidity amount of 55%, and dry position 210C may correspond to a relative humidity amount of 65%.

FIG. 3 illustrates a zone selection map 300, according to certain embodiments. In this embodiment, zone selection map 300 illustrates various climate zones 310 of a geographical region 320 (e.g., the United States). In this example, climate zones 310 include a humid zone 310A, a moderate zone 310B, and a dry zone 310C. While a specific number of climate zones 310 are illustrated in FIG. 3, other embodiments may have any appropriate number of climate zones 310. Furthermore, geographical regions 320 may be any continent, country, state, county, city, or other appropriate geographical region.

In some embodiments, zone selection map 300 may be divided into climate zones 310 based on a predetermined mean daily dew point. For example, the mean daily dew point may be obtained, measured, or calculated for cities within geographical region 320 using any appropriate method. As a specific example, historical weather data may be analyzed to determine the mean daily dew point for cities within geographical region 320. In some embodiments, the mean daily dew point may be determined by averaging the daily dew point for each city over a one year period. Once the mean daily dew point for cities within geographical region 320 are determined, they may be categorized into one of climate zones 310 based on the determined mean daily dew point. For example, if a city has a mean daily dew point that is a certain percentage below a predetermined mean daily dew point (e.g., ten percent or more below a mean daily dew point of 55 degrees Fahrenheit), it may be classified as a dry zone 310C. If a city has a mean daily dew point that is a certain percentage above a predetermined mean daily dew point (e.g., ten percent or more above a mean daily dew point of 55 degrees Fahrenheit), it may be classified as a humid zone 310A. If a city has a mean daily dew point that is within a certain percentage of a predetermined mean daily dew point (e.g., within ten percent above or below a mean daily dew point of 55 degrees Fahrenheit), it may be classified as a moderate zone 310B. As a result, geographical region 320 may be partitioned into climate zones 310 that may be plotted or otherwise displayed on an electronic or physical (e.g., paper) map and used to select user-selectable positions 210 of zone selection switch 105.

In operation, dehumidifying ventilator 100 actively dehumidifies input airflow 101 when the moisture level of input airflow 101 exceeds a relative humidity threshold that is based on a physical location of the ventilating system. For example, a map such as zone selection map 300 may be provided to an installer that displays a geographical region 320 (e.g., a country, state, county, city, etc.) in which dehumidifying ventilator 100 is to be installed. As discussed above, zone selection map 300 may be partitioned into a predetermined number of climate zones 310 based on a mean daily dew point reference temperature (e.g., 55 degrees Fahrenheit). The user or installer may consult zone selection map 300 and determine that dehumidifying ventilator 100 is installed in, for example, a humid zone 310A. Zone selection switch 105 may then be set to a corresponding user-selectable position 210, which in this example would be humid position 210A. This sets dehumidifying ventilator 100 to enable dehumidistat switch 125 (and therefore enabling dehumidification system 120) when a relative humidity of input airflow 101 equals or exceeds a particular relative humidity associated with humid position 210A. For example, if humid position 210A corresponds to a relative humidity amount of 40%, dehumidifying ventilator 100 will provide dehumidification to input airflow 101 when the relative humidity of input airflow 101 equals or exceeds 40%. Similarly, dehumidifying ventilator 100 will not provide dehumidification to input airflow 101 when the relative humidity of input airflow 101 is below 40%. By enabling/disabling dehumidification system 120 within dehumidifying ventilator 100 based on the climate region in which dehumidifying ventilator 100 is installed, the amount of overdrying and underdrying of the ventilating system may be minimized, thereby saving energy and increasing the affordability of dehumidifying ventilator 100. Furthermore, because zone selection switch 105 and dehumidistat switch 125 are each electro-mechanical switches in some embodiments, dehumidifying ventilator 100 is able to operate without expensive electronic controls, which further reduces the up-front and maintenance costs of dehumidifying ventilator 100. In addition, unlike other ventilation systems, dehumidification system 120 of dehumidifying ventilator 100 may be enabled/disabled based on relative humidity alone and may not require any temperature inputs. This may further reduce the cost of dehumidifying ventilator 100.

FIG. 4 illustrates a method 400 of controlling dehumidifying ventilator 100, according to certain embodiments. Method 400 may begin in step 410 where a user-selection of a particular one of a plurality of user-selectable positions of a zone selection switch is received. In some embodiments, each position of the zone selection switch corresponds to a particular climate zone of a plurality of climate zones, and each climate zone of the plurality of climate zones corresponds to a particular relative humidity. In some embodiments, the zone selection switch is zone selection switch 105 and the user-selectable positions are user-selectable positions 210. In some embodiments, the climate zones are climate zones 310.

At step 420, a relative humidity of an input airflow to the dehumidifying ventilator is received. In some embodiments, the relative humidity is received from a sensor such as sensor 190. In some embodiments, the sensor is within an input airflow to the dehumidifying ventilator.

At step 430, the received relative humidity of the input airflow of step 420 is compared to the particular relative humidity corresponding to the selected position of the zone selection switch of step 410. If it is determined that the relative humidity of the input airflow is greater than or equal to the particular relative humidity corresponding to the selected position of the zone selection switch, method 400 proceeds to step 440 where a dehumidification system of the dehumidifying ventilator is enabled. In some embodiments, step 440 includes enabling a compressor, enabling a fan such as fan 110, and opening a damper such as damper 180. If it is determined that the relative humidity of the input airflow is less than the particular relative humidity corresponding to the selected position of the zone selection switch, method 400 proceeds to step 450 where a dehumidification system of the dehumidifying ventilator is disabled. In some embodiments, step 450 includes disabling a compressor, enabling a fan such as fan 110, and opening a damper such as damper 180.

Although a particular implementation of dehumidifying ventilator 100 is illustrated and primarily described, the present disclosure contemplates any suitable implementation of dehumidifying ventilator 100 according to particular needs. Moreover, although various components of dehumidifying ventilator 100 have been depicted as being located at particular positions, the present disclosure contemplates those components being positioned at any suitable location, according to particular needs. In addition, certain threshold comparison operations may be altered to suit any applications. For example, while certain embodiments describe enabling dehumidistat switch 125 when a relative humidity of input airflow 101 is above or equal to a threshold relative humidity, other embodiments may only enable dehumidistat switch 125 when the relative humidity of input airflow 101 is above the threshold relative humidity (and not when it is equal to the threshold relative humidity). Similarly, while certain embodiments describe disabling dehumidistat switch 125 when the relative humidity of input airflow 101 is below a threshold relative humidity, other embodiments may enable dehumidistat switch 125 when the relative humidity of input airflow 101 is below or equal to the threshold relative humidity.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A dehumidifying ventilator, comprising:

a fan operable to generate an airflow through the dehumidifying ventilator, the airflow comprising an input airflow that flows into the dehumidifying ventilator and an output airflow that flows out of the dehumidifying ventilator;

a dehumidification system operable to provide dehumidification to the airflow;

a dehumidistat switch operable to enable and disable the dehumidification system of the dehumidifying ventilator; and an zone selection switch coupled to the dehumidistat switch, the zone selection switch comprising a plurality of user-selectable positions, each position of the zone selection switch corresponding to a particular climate zone of a plurality of climate zones, each climate zone of the plurality of climate zones corresponding to a particular relative humidity, the zone selection switch operable to:

cause the dehumidistat switch to enable the dehumidification system when a relative humidity of the input airflow is greater than or equal to the particular relativity humidity of a selected position of the zone selection switch; and cause the dehumidistat switch to disable the dehumidification system when the relative humidity of the input airflow is less than the particular relativity humidity of the selected position of the zone selection switch.

2. The dehumidifying ventilator of claim 1, wherein the plurality of climate zones of the user-selectable positions of the zone selection switch comprise:

a dry zone;

a moderate zone; and a humid zone.

3. The dehumidifying ventilator of claim 1, wherein each climate zone corresponds to one of a plurality of defined areas of a geographical region, the geographical region comprising a continent, a country, a state, a county, or a city.

4. The dehumidifying ventilator of claim 3, wherein the plurality of defined areas of the geographical region are based on a predetermined mean daily dew point.

5. The dehumidifying ventilator of claim 1, wherein the zone selection switch comprises an electro-mechanical switch.

6. The dehumidifying ventilator of claim 1, wherein the relative humidity of the input airflow is measured by a sensor within the input airflow.

7. The dehumidifying ventilator of claim 1, wherein the zone selection switch further comprises:

a user-selectable on position that cause the dehumidistat switch to enable the dehumidification system without regard to the relative humidity of the input airflow; and a user-selectable off position that cause the dehumidistat switch to disable the dehumidification system without regard to the relative humidity of the input airflow.

8. A dehumidifying ventilator, comprising:

a dehumidistat switch operable to enable and disable dehumidification of the dehumidifying ventilator; and a user-selection switch coupled to the dehumidistat switch, the switch comprising a plurality of user-selectable positions, each position of the user-selection switch switch corresponding to a particular climate zone of a plurality of climate zones, each climate zone of the plurality of climate zones corresponding to a particular relative humidity, the user-selection switch operable to:

cause the dehumidistat switch to enable the dehumidification system when a relative humidity of the input airflow is greater than or equal to the particular relativity humidity of a selected position of the user-selection switch; and cause the dehumidistat switch to disable the dehumidification system when the relative humidity of the input airflow is less than the particular relativity humidity of the selected position of the user-selection switch.

9. The dehumidifying ventilator of claim 8, wherein the plurality of climate zones of the user-selectable positions of the user-selection switch comprise:

a dry zone;

a moderate zone; and a humid zone.

10. The dehumidifying ventilator of claim 8, wherein each climate zone corresponds to one of a plurality of defined areas of a geographical region, the geographical region comprising a continent, a country, a state, a county, or a city.

11. The dehumidifying ventilator of claim 10, wherein the plurality of defined areas of the geographical region are based on a predetermined mean daily dew point.

12. The dehumidifying ventilator of claim 8, wherein the user-selection switch comprises an electro-mechanical switch.

13. The dehumidifying ventilator of claim 8, wherein the relative humidity of the input airflow is measured by a sensor within the input airflow.

14. The dehumidifying ventilator of claim 8, wherein the user-selection switch further comprises:

a user-selectable on position that cause the dehumidistat switch to enable the dehumidification system without regard to the relative humidity of the input airflow; and a user-selectable off position that cause the dehumidistat switch to disable the dehumidification system without regard to the relative humidity of the input airflow.

15. A method of controlling a dehumidifying ventilator, the method comprising:

receiving a user-selection of a particular one of a plurality of user-selectable positions of a zone selection switch, each position of the zone selection switch corresponding to a particular climate zone of a plurality of climate zones, each climate zone of the plurality of climate zones corresponding to a particular relative humidity;

receiving a relative humidity of an input airflow to the dehumidifying ventilator;

comparing the received relative humidity of the input airflow to the particular relative humidity corresponding to the selected position of the zone selection switch, and in response:

enabling a dehumidification system of the dehumidifying ventilator when it is determined that the relative humidity of the input airflow is greater than or equal to the particular relative humidity corresponding to the selected position of the zone selection switch; and disabling the dehumidification system of the dehumidifying ventilator when it is determined that the relative humidity of the input airflow is less than the particular relative humidity corresponding to the selected position of the zone selection switch.

16. The method of controlling the dehumidifying ventilator of claim 15, wherein the plurality of climate zones of the user-selectable positions of the user-selection switch comprise:

a dry zone;

a moderate zone; and a humid zone.

17. The method of controlling the dehumidifying ventilator of claim 15, wherein each climate zone corresponds to one of a plurality of defined areas of a geographical region, the geographical region comprising a continent, a country, a state, a county, or a city.

18. The method of controlling the dehumidifying ventilator of claim 17, wherein the plurality of defined areas of the geographical region are based on a predetermined mean daily dew point.

19. The method of controlling the dehumidifying ventilator of claim 15, wherein the zone selection switch comprises an electro-mechanical switch.

20. The method of controlling the dehumidifying ventilator of claim 15, wherein the relative humidity of an input airflow to the dehumidifying ventilator is received from a sensor within the input airflow.

* * * * *